US006435122B1

(12) United States Patent
Skulnick

(10) Patent No.: US 6,435,122 B1
(45) Date of Patent: Aug. 20, 2002

(54) BOAT FENDER

(75) Inventor: Steve Skulnick, Ramona, CA (US)

(73) Assignee: The Skulnick Family Trust, Ramona, CA (US)

( * ) Notice: Subject to any disclaimer, the term of this patent is extended or adjusted under 35 U.S.C. 154(b) by 0 days.

(21) Appl. No.: 09/802,981

(22) Filed: Mar. 12, 2001

(51) Int. Cl.[7] ..... B63B 59/02
(52) U.S. Cl. ..... 114/219
(58) Field of Search ..... D12/168; 114/219; 405/212, 215

(56) References Cited

U.S. PATENT DOCUMENTS

| | | | | |
|---|---|---|---|---|
| 3,411,304 | A | * 11/1968 | Miller | 114/219 |
| 3,693,572 | A | 9/1972 | Crook | |
| 3,744,445 | A | 7/1973 | Malenka | |
| 3,765,366 | A | 10/1973 | Connelly | |
| 3,825,682 | A | 7/1974 | Jochimski | |
| 3,964,422 | A | 6/1976 | Boyd | |
| 3,988,997 | A | 11/1976 | Fenton | |
| D299,915 | S | 2/1989 | Ullman et al. | |
| 4,840,893 | A | 6/1989 | Ellison | |
| 4,843,994 | A | 7/1989 | Wilson et al. | |
| D308,192 | S | 5/1990 | Ellison | |
| D313,217 | S | 12/1990 | Kajigaya | |
| 5,018,471 | A | 5/1991 | Stevens | |
| 5,037,242 | A | 8/1991 | Nill | |
| 5,048,446 | A | 9/1991 | Powell | |
| 5,247,897 | A | * 9/1993 | Pepp | 114/219 |
| 5,273,473 | A | 12/1993 | Allen | |
| 5,355,822 | A | 10/1994 | Lemke | |
| D359,019 | S | 6/1995 | Kimball | |
| 5,441,006 | A | 8/1995 | Wood | |
| 5,487,349 | A | 1/1996 | Andreassen | |
| 5,560,312 | A | 10/1996 | McPherson | |
| 5,562,364 | A | 10/1996 | Darder-Alomar | |
| 5,628,270 | A | 5/1997 | Ryll et al. | |
| 5,660,133 | A | 8/1997 | Munich | |
| 5,671,692 | A | 9/1997 | Kimball | |
| 5,878,685 | A | 3/1999 | Hemphill et al. | |
| D425,461 | S | 5/2000 | Beyer-Olsen | |
| D430,083 | S | 8/2000 | Spearin | |

FOREIGN PATENT DOCUMENTS

| | | | |
|---|---|---|---|
| DE | 25 50 514 A 1 | * 5/1977 | 114/219 |
| SU | 1268470 | * 11/1986 | 114/219 |
| SU | 1355545 A1 | * 11/1987 | 114/219 |

* cited by examiner

*Primary Examiner*—Sherman Basinger
(74) *Attorney, Agent, or Firm*—Liniak, Berenato, Longacre & White

(57) ABSTRACT

A boat fender with an outer contour designed to prevent damage to the boat, to enhance the retention of a boat to a dock or pillar, and to prevent movement of a boat along its longitude or length while moored to a dock. The boat fender has a V-shaped outer contour designed to receive the pillar of a dock or other docking structure. The boat fender of this invention is designed to easily receive the cylindrical post or pillar common forming the docking structure used during boating.

14 Claims, 4 Drawing Sheets

Fig. 1
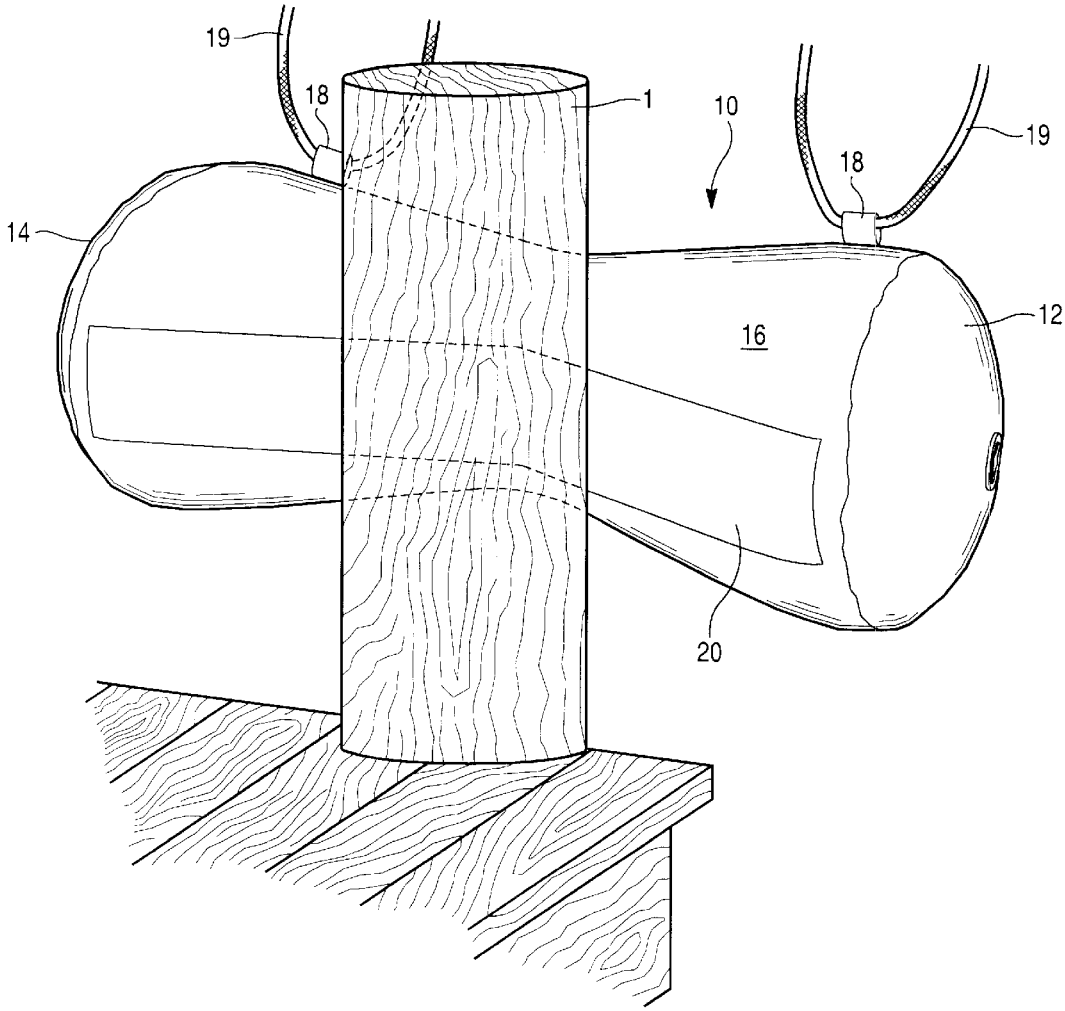
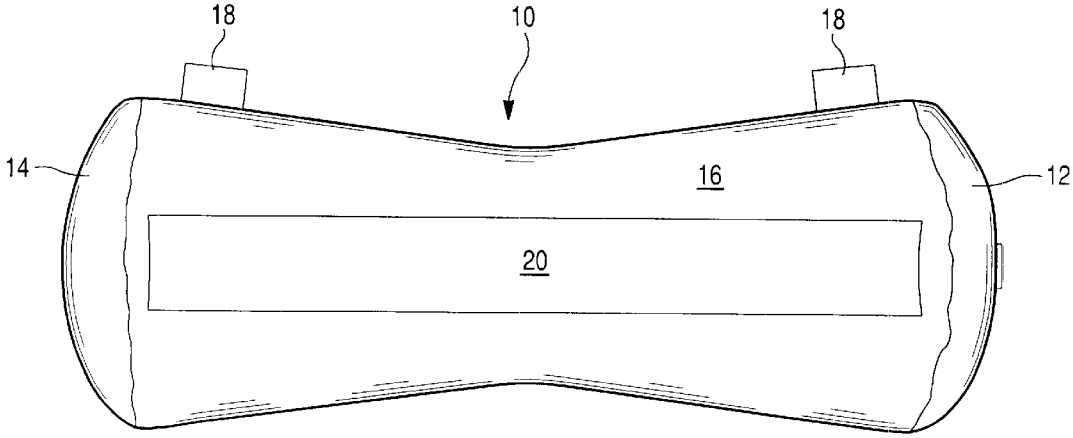
Fig. 2

BOAT FENDER

BACKGROUND OF THE INVENTION

1. Field of the Invention

The present invention relates to an improved boat fender which not only absorbs docking impact but effectively centers itself onto the pole or piling while the boat is docked.

2. Background Art

When a boat is being docked, it is common to position several fenders along the side of the boat so that the fenders are positioned between the side of the hull of the boat and the dock to cushion any impact. Quite commonly these fenders are elongate cylindrical members that are connected at one or both ends to a rope that in turn is tied or attached by tying the rope around the railing of the boat.

Various structures have been used as boat fenders, especially for absorbing impact and protecting the boat following docking contact. Such bumpers or fenders commonly assume the configuration of cylinders or rollers and are commonly suspended by lines along the sides of the boat hull. The fenders are principally designed to absorb impact although they have some braking action from frictional contact of the elastomeric material with the docking structure.

A major defect in conventional boat fenders is the inability of the fender to center on the pole or piling of the dock. Conventional boat fenders have a cylindrical configuration, but these conventional designs tend to slip out of position with respect to the piling or pole of the dock.

Any device or system that is used on a boat should be reliable, easily stowable (if it is to be stowed) and also convenient to mount or dismount (or connect or disconnect) if that is part of the function of the device. Further, nautical devices should be easy to use and function as intended.

There is a need for an improved boat fender that reliably protects a boat from the docking structure while centering on the pole or piling of the docking structure.

SUMMARY OF THE INVENTION

The present invention provides an improved boat fender that reliable protects a boat from damage by a docking structure and centers on the pole or piling of the docking structure.

It is an object of the present invention to provide a boat fender with an outer contour designed to enhance its centering ability with respect to a pole or piling. It is also the object of this invention to prevent slipping out of position and away from the pole or piling while moored to a dock.

The invention achieves the above-stated objectives by providing a boat fender having a V-shaped outer contour designed to receive the piling of a dock or other docking structure. The boat fender of this invention is designed to easily receive the cylindrical pole or piling commonly forming the docking structure used during boating.

It is yet another object of the invention to provide a boat fender or bumper that is either inflatable or non-inflatable.

It is yet another object of the invention to provide a boat fender or bumper that ay be made of at least one of PVC (e.g., 30 oz., 42 oz.), rubber, foam, or any suitable lastomeric or resilient material.

These and other objectives will be achieved with reference to the following drawings and associated description.

BRIEF DESCRIPTION OF THE DRAWINGS

FIG. 1 is a perspective view of a boat fender shown in relation to a docking pier for mooring a boat to a dock.

FIG. 2 is a front view of the boat fender of FIG. 1.

DETAILED DESCRIPTION OF THE PREFERRED EMBODIMENTS

With reference to the attached drawings, the present invention will now be described in the environment of usage for the boat fender of this invention.

Figure 3:
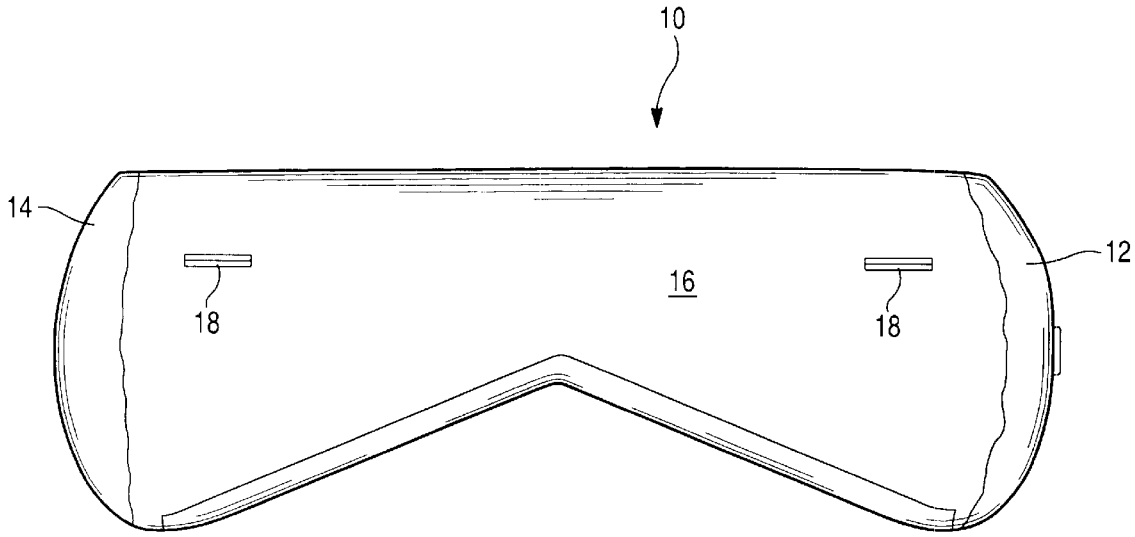
FIG. 3 is a top view of the boat fender of FIG. 1.

FIGS. 1–3 show a preferred embodiment of this invention whereby the boat bumper or fender 10 is positioned adjacent a pole or piling 1 of a docking structure. The boat fender 10 comprises a first end 12, and a second end 14 with a main body portion 16 extending along a longitudinal length from the first end 12 to the second end 14. Mounting rings 18 are affixed to the main body portion 16 along a top surface and preferably along a seam (not shown) to provide adequate attachment of the mounting rings 18 to the main body portion 16. The mounting rings 18 may take a variety of forming including but not limited to a metallic ring, a loop-shaped fabric strap or other fastening member for receiving a rope 19 secured to a boat (not shown).

Figure 4:
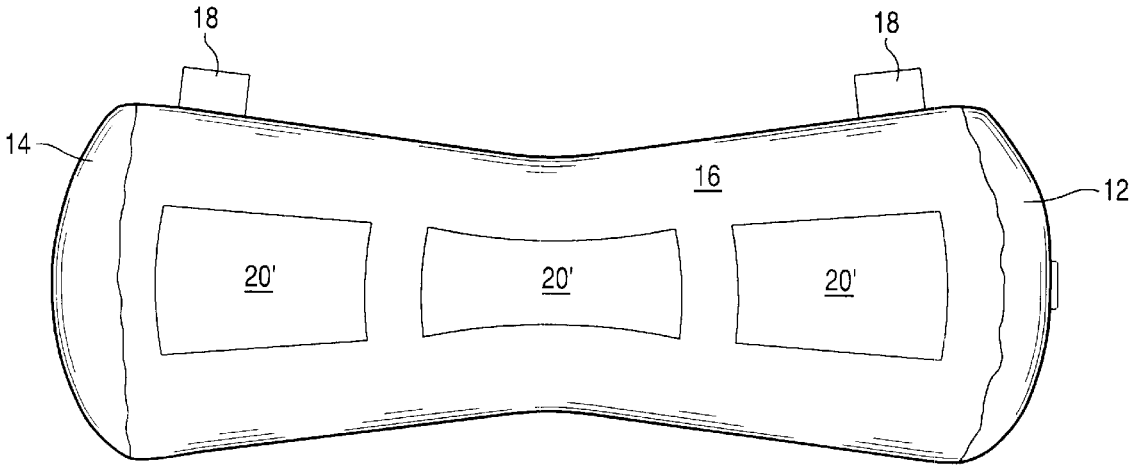
FIG. 4 is an alternate embodiment of the boat fender according to the present invention with modified friction buffers shown in relation to the docking pier of FIG. 1.

The boat fender 10 is formed of materials adequate to endure the rigors and hazards associated with docking structures. When the boat fender 10 abuts the piling 1, it is important that the boat fender 10 not wear due to frictional resistance. Therefore, the boat fender 10 is provided with at least one frictional abutment member 20 positioned to engage the piling 1. As shown in FIGS. 1–3, the frictional abutment member 20 may comprise a single strip of heavy-duty friction resistant material or, as shown in FIG. 4, the frictional abutment member 20 comprises a series of patches 20' aligned along the longitudinal length of the fender 10.

Figure 5A:
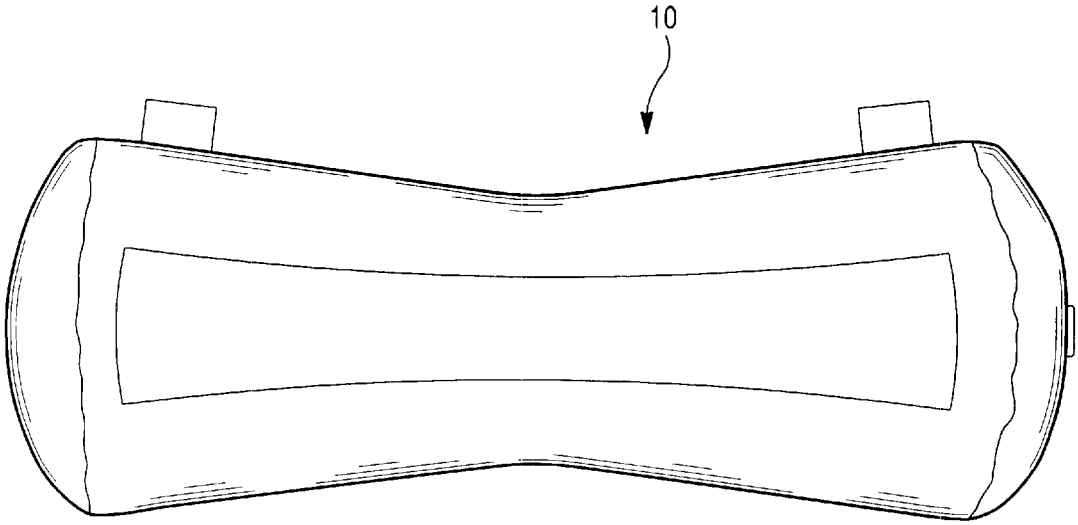
FIGS. 5A and 5B are front and top view, respectively, of another alternate embodiment showing an hour-glass contour for the boat fender of this invention.
Figure 5B:
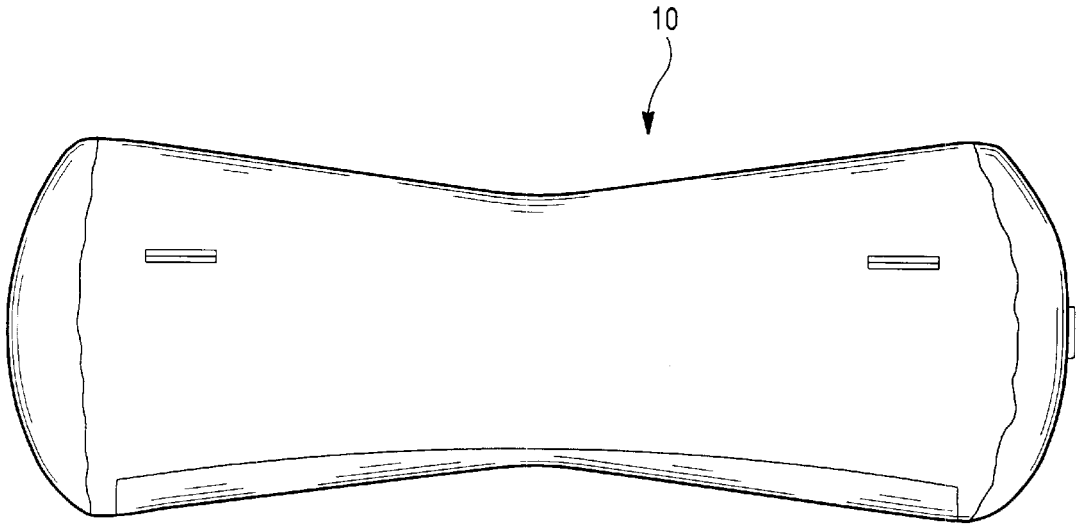
Figure 6:
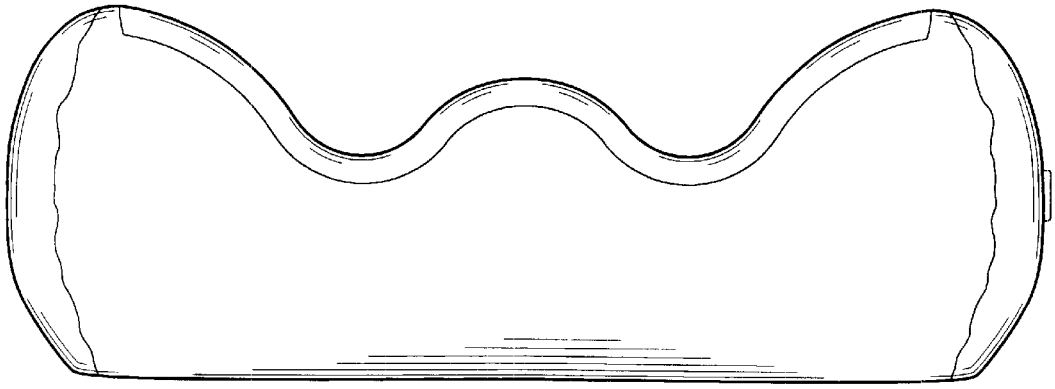
FIG. 6 is an alternate embodiment showing a camel-back contour for the boat fender of this invention.

FIGS. 5A and 5B show a modified embodiment of the instant invention where the boat fender 10 is formed with an hour-glass contour. With the design of FIGS. 5A–5B, the boat fender 10 may be located at numerous positions along a boat to simplify the method of positioning the boat fender along the side of a boat. FIG. 6 shows another embodiment of the invention whereby the boat fender 10 is formed with a camel-back contour to fit various mooring structures having, for example, side-by-side poles forming a part of the dock.

Figure 7:
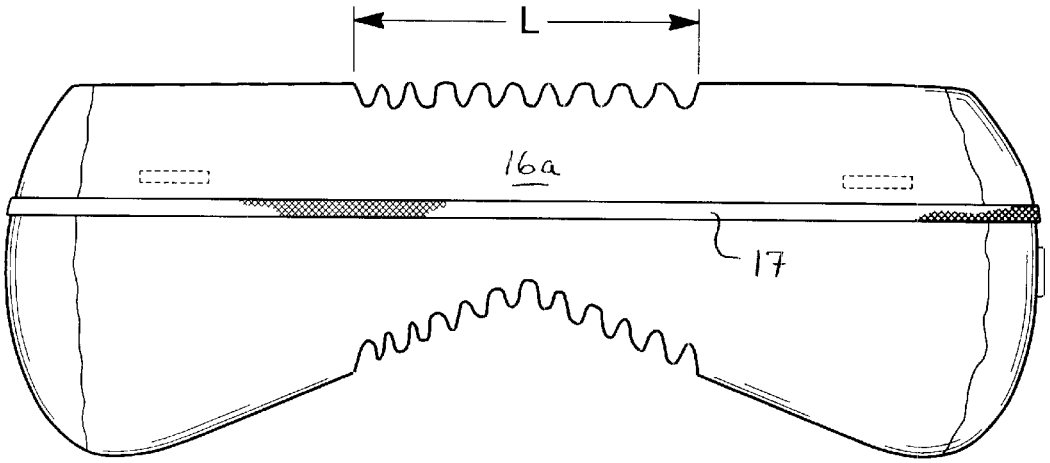
FIG. 7 is yet another embodiment of the present invention whereby the longitudinal dimension of the boat fender may be varied to fit the mooring structure to which the boat fender is engaged.

FIG. 7 shows an exemplary embodiment of the instant invention where the longitudinal dimension of the boat fender 10 may be varied to fit the dimensions and arrangement of the docking structure. The boat fender 10 shown in FIG. 7 has an accordion-like structure 16*a* at its mid-section that permits the operator to adjust the length 'L' of the longitudinal length of the boat fender 10. The length 'L' can be controlled, for example, by lengthening or shortening a strap 17. With this arrangement, the boat fender 10 may accommodate different sized poles or pilings 1.

Although the present invention has been shown and described with references to several preferred embodiments, it will be understood that various changes in form and detail may be made therein without departing from the spirit and scope of the present invention. For example, the material of the present invention may be varied and selected according to the environment and usage envisioned for the particular boat and its environment. The fender may be inflatable or non-inflatable. In addition, the specific materials used to form the boat fender 10 may be selected from any material having sufficient resiliency and deformability, such as PVC (e.g., 30 oz. core mill or 42 oz. core mill), rubber, plastic, foam, etc. In addition, the frictional characteristics and layout of the friction members 20, 20' may be varied according to usage and environment. Although the fender is illustrated with a circular cross-section, the fender may be formed with a polygonal or irregularly shaped cross-section.

What is claimed is:

1. A bumper structure for a floating vessel, comprising:

an elongated resilient member having a first end and a second end along a longitudinal direction; said resilient member having an outer contour defining a circular shape in cross-section and a circumference circumscribing said longitudintal direction; said outer contour having a first circumference at said first end, a second circumference at said second end, and a third circumference at an area between said first and second ends;

wherein said third circumference is smaller than said first circumference and said second circumference, and wherein said resilient member has a first length extending substatiallly linearly from said first end to said second end and a second length defining one of a substantially v-shaped portion and a substantially unshaved portion, wherein said first length is disposed opposite said second length with respect to said longitudinal direction.

2. The bumper structure according to claim 1, wherein said outer contour is continuously reduced from said first circumference to said third circumference.

3. The bumper structure according to claim 1, wherein said outer contour is continuously reduced from said second circumference to said third circumference.

4. The bumper structure according to claim 1, wherein outer contour defines an irregular contour reduced from said first circumference to said third circumference.

5. The bumper structure according to claim 1, wherein outer contour defines an irregular contour reduced from said second circumference to said third circumference.

6. The bumper structure according to claim 1, wherein said resilient member is made from at least one material selected from the group consisting of polyvinyl chloride, rubber, plastic, and foam.

7. The bumper structure according to claim 1, wherein said resilient member is inflatable.

8. The bumper structure according to claim 1, further comprising at least one frictional abutment member disposed on said outer contour, said frictional abutment member having a higher durability than a material forming said outer contour.

9. A bumper structure for a floating vessel, comprising:

an elongated resilient member having an outer contour defining a circular shape in cross-section and a circumferential surface circumscribing a longitudinal axis, said outer contour has a centrally oriented circumference defining a minimal circumference of said resilient member, wherein said outer contour defines a first circumference at a first end, a second circumference at a second end, and a third circumference at an area between said first and second ends, and wherein said third circumference is smaller than said first circumference and said second circumference, and wherein said resilient member has a first length extending substantiallly linealy from said first end to said second end and a second length defining at least one of a substantially u-shaped portion and a substantially v-shaped portion, wherein said first length is disposed opposite said second length with respect to said longitudinal direction.

10. The bumper structure according to claim 9, wherein said resilient member is inflatable.

11. The bumper structure according to claim 9, wherein said circumferential surface is substantially circular in cross-section throughout its length.

12. The bumper structure according to claim 9, wherein said outer contour is continuously reduced from said first circumference to said third circumference.

13. The bumper structure according to claim 9, wherein said outer contour is continuously reduced from said second circumference to said third circumference.

14. The bumper structure according to claim 9, wherein said outer contour defines an irregular contour reduced from said first circumference to said third circumference.

* * * * *